US007347520B2

(12) United States Patent
Ito

(10) Patent No.: US 7,347,520 B2
(45) Date of Patent: Mar. 25, 2008

(54) INKJET PRINTING APPARATUS AND INFORMATION PROCESSING METHOD

(75) Inventor: Hideyuki Ito, Tokyo (JP)

(73) Assignee: Canon Finetech Inc., Joso-shi (JP)

( * ) Notice: Subject to any disclaimer, the term of this patent is extended or adjusted under 35 U.S.C. 154(b) by 117 days.

(21) Appl. No.: 11/341,626

(22) Filed: Jan. 30, 2006

(65) Prior Publication Data

US 2006/0176330 A1 Aug. 10, 2006

(30) Foreign Application Priority Data

Feb. 7, 2005 (JP) ..... 2005-030567

(51) Int. Cl.
*B41J 29/38* (2006.01)

(52) U.S. Cl. ..... 347/14; 347/6

(58) Field of Classification Search ..... 347/14, 347/11, 17, 6
See application file for complete search history.

(56) References Cited

U.S. PATENT DOCUMENTS 6,958,826 B1 * 10/2005 Walmsley et al. ..... 358/1.2

FOREIGN PATENT DOCUMENTS

JP 07-178924 7/1995

* cited by examiner

*Primary Examiner*—Thinh Nguyen
(74) *Attorney, Agent, or Firm*—Fitzpatrick, Cella, Harper & Scinto

(57) ABSTRACT

Ink viscosity information of an inkjet printing apparatus can be provided at low cost in small space. The inkjet printing apparatus performs image printing by using a printhead with a plurality of nozzles from which ink is discharged. This inkjet printing apparatus includes a switching unit which switches to a test print mode for providing the ink viscosity information. The inkjet printing apparatus also includes an image printing unit which prints a predetermined image in response to a plurality of driving pulses with different frequencies to obtain a test print pattern, when the switching unit switches to the test print pattern.

16 Claims, 8 Drawing Sheets

INKJET PRINTING APPARATUS AND INFORMATION PROCESSING METHOD

FIELD OF THE INVENTION

The present invention relates to an inkjet printing apparatus and an information processing method for the inkjet printing apparatus.

BACKGROUND OF THE INVENTION

A so-called "inkjet printing apparatus" has been popular, in which heat energy corresponding to a driving pulse is applied to ink to generate bubbles by film boiling, and ink is discharged from printheads onto a print medium such as paper by generated bubbles to print an image.

In this inkjet printing apparatus, in order to maintain high-quality image printing, it is important for a user to optimally manage ink viscosity. Hence, in order to optimally manage ink viscosity, the inkjet printing apparatus has a function of monitoring a change in ink viscosity, and when ink viscosity falls outside a predetermined allowance, notifying the user of a message indicating this. Since the inkjet printing apparatus has such function, the user can take an appropriate action such as replacing an ink cartridge of a predetermined color, on the basis of this notification (as described above, output information required to take the appropriate action is generally referred to as "ink viscosity information").

Most of conventional inkjet printing apparatuses monitor the change in ink viscosity by measuring the electrical conductivity of ink, the pressure in an ink channel, and the like (e.g., see Japanese Patent Laid-Open No. 7-178924).

However, the method of monitoring the change in ink viscosity by measuring the electrical conductivity and pressure poses the burden of cost, and increases an apparatus size, thus posing a problem. Hence, a demand has arisen for providing ink viscosity information required to take an appropriate action for ink at low cost without an increase in the apparatus size.

SUMMARY OF THE INVENTION

The present invention has been made in consideration of the above problems, and can provide ink viscosity information of an inkjet printing apparatus at low cost in small space.

In one aspect, an inkjet printing apparatus which prints an image using a printhead having a plurality of nozzles from which ink is discharged, comprises:

a switching unit configured to switch to a test print mode for providing information about a viscosity of the ink; and an image printing unit configured to print predetermined images in response to a plurality of driving pulses with different frequencies when the switching unit switches to the test print mode.

According to the present invention, ink viscosity information of an inkjet printing apparatus can be provided at low cost in small space.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

First Embodiment

<Device Arrangement of Inkjet Printing Apparatus>

Figure 1:
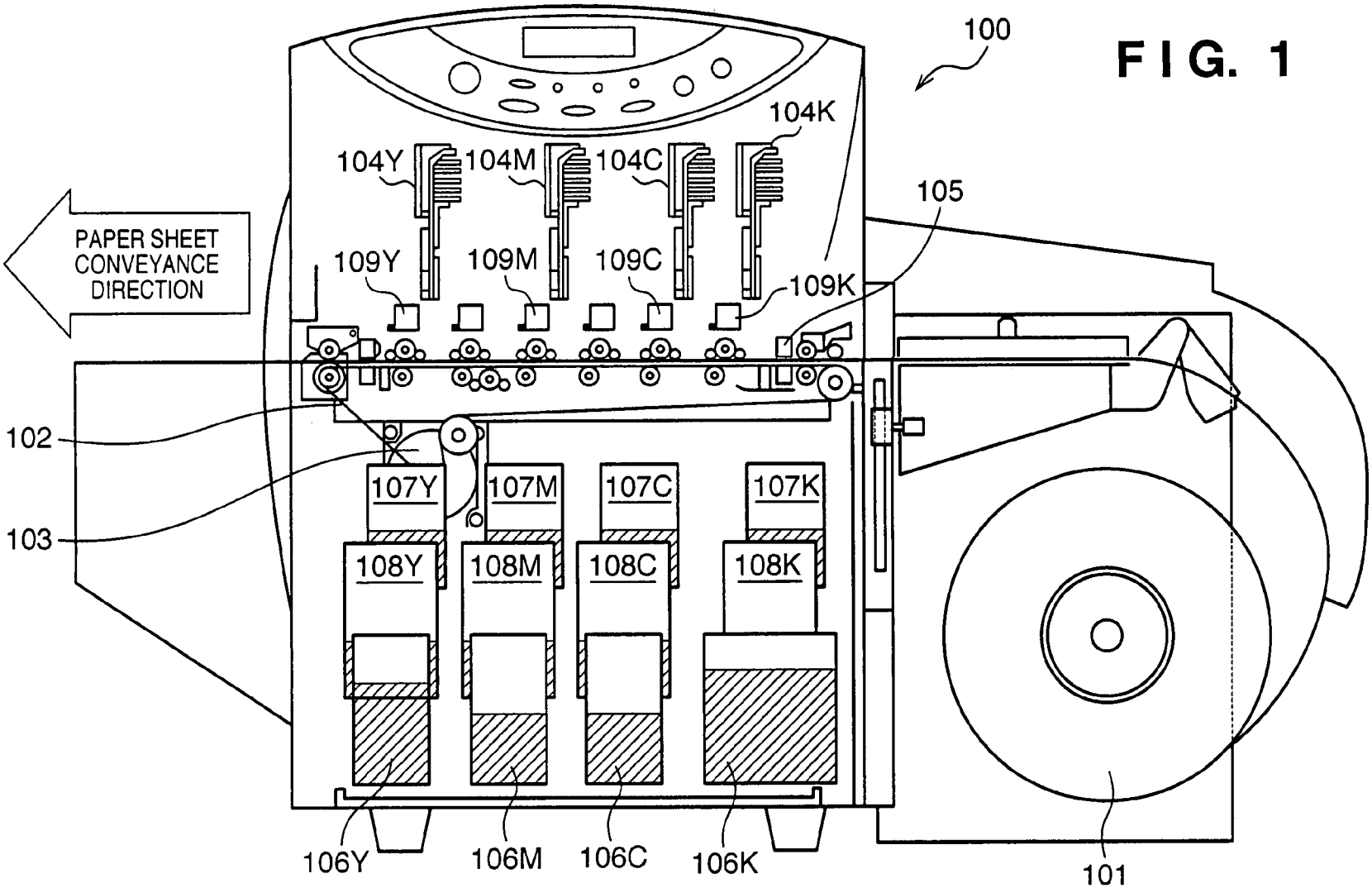
FIG. 1 is a view showing the internal arrangement of an inkjet printing apparatus according to an embodiment of the present invention.

FIG. 1 is a view showing the device arrangement of an inkjet printing apparatus (100) according to an embodiment of the present invention. In FIG. 1, reference numeral 101 denotes a rolled label paper sheet (print medium) on which a plurality of labels are temporarily stuck. The label paper sheet is conveyed in a "paper sheet conveyance direction" indicated by an arrow in FIG. 1, at a constant speed using a conveyance belt 102 driven by a conveyance motor 103.

Reference numerals 104K, 104C, 104M, and 104Y denote printheads. When a leading edge sensor 105 senses the leading edge of each label on the label paper sheet 101, image printing is performed on each label at a predetermined printing timing by using the printheads (104K, 104C, 104M, and 104Y), with reference to the sensed label position.

Color image printing is performed by using the printheads, e.g., printheads 104K (black ink printhead), 104C (cyan ink printhead), 104M (magenta ink printhead), and 104Y (yellow ink printhead) corresponding to four color inks. Note that in the first embodiment, each printhead (104K, 104C, 104M, or 104Y) serves as a line head having a printing width corresponding to the maximum width of the label to be used.

In the lower portion of the inkjet printing apparatus 100, ink cartridges 106K, 106C, 106M, and 106Y, subtanks 107K, 107C, 107M, and 107Y, and waste ink tanks 108K, 108C, 108M, and 108Y are arranged in correspondence with the respective printheads 104K, 104C, 104M, and 104Y.

Also, in the lower portions of the printheads 104K, 104C, 104M, and 104Y, capping mechanisms 109K, 109C, 109M, and 109Y are respectively arranged. Note that six capping mechanisms are shown in FIG. 1, which include preliminary mechanisms for additional ink, e.g., pale cyan, pale magenta, or special color ink.

The ink cartridges 106K, 106C, 106M, and 106Y, subtanks 107K, 107C, 107M, and 107Y, printheads 104K, 104C, 104M, and 104Y, waste ink tanks 108K, 108C, 108M, and 108Y, and capping mechanisms 109K, 109C, 109M, and 109Y are connected via ink tubes, each of which is separated for each ink color (to be described later in detail).

<Hardware Arrangement of Inkjet Printing Apparatus>

The hardware arrangement of the inkjet printing apparatus 100 will be described next with reference to FIG. 2. Note that the same reference numerals as in FIG. 1 denote the same parts in FIG. 2.

Reference numeral 220 denotes a host computer. Print data transmitted from the host computer 220 is received by an interface controller 202 of the inkjet printing apparatus 100.

The interface controller 202 also receives and analyzes various commands including data (e.g., the number, type, and size of the label) of the label paper sheet 101 serving as the print medium on which an image is to be printed, and an identification result obtained based on a test print pattern (ink viscosity information) read by an image reading apparatus 230 (to be described later in detail).

Reference numeral 201 denotes a CPU (Central Processing Unit), which controls the overall operations such as command analysis, print data reception, image printing operation, and print medium handling in the inkjet printing apparatus 100.

The print data received via the interface controller 202 is analyzed by the CPU 201, and then bitmapped to an image memory 204 as image data for each color component.

As operation processing prior to image printing, the CPU 201 drives both a capping motor (not shown) and head motor (not shown) via an input/output port (I/O) 210 and motor driving unit 211, and moves each of the printheads 104K, 104C, 104M, and 104Y from a capping position (standby position) to a print position (position of each printhead in image printing).

The CPU 201 substantially simultaneously drives a paper feed motor (not shown) and the conveyance motor 103 for feeding the label paper sheet 101 serving as the print medium, and continuously conveys the label paper sheet 101.

When the leading edge sensor 105 detects the leading edge of the label in order to determine a timing at which printing is performed on the label paper sheet 101 conveyed at a constant speed, the detected signal is input to the CPU 201 via an I/O 208.

In synchronism with conveyance of the label paper sheet 101 by the conveyance motor 103, the CPU 201 sequentially reads out image data of corresponding colors from the image memory 204, and transfers the readout image data to the respective printheads 104K, 104C, 104M, and 104Y via a printhead control circuit 209 to perform color printing.

The CPU 201 operates based on various control programs stored in a program ROM 203 to control the overall inkjet printing apparatus 100.

Such control programs include, e.g., a control program corresponding to the procedure shown in the flowchart (FIGS. 3A and 3B) to be described later, and a control program for generating the test print pattern in a test print mode to be describe later (these control programs use a work RAM 205 as a working memory in execution).

Figure 6:
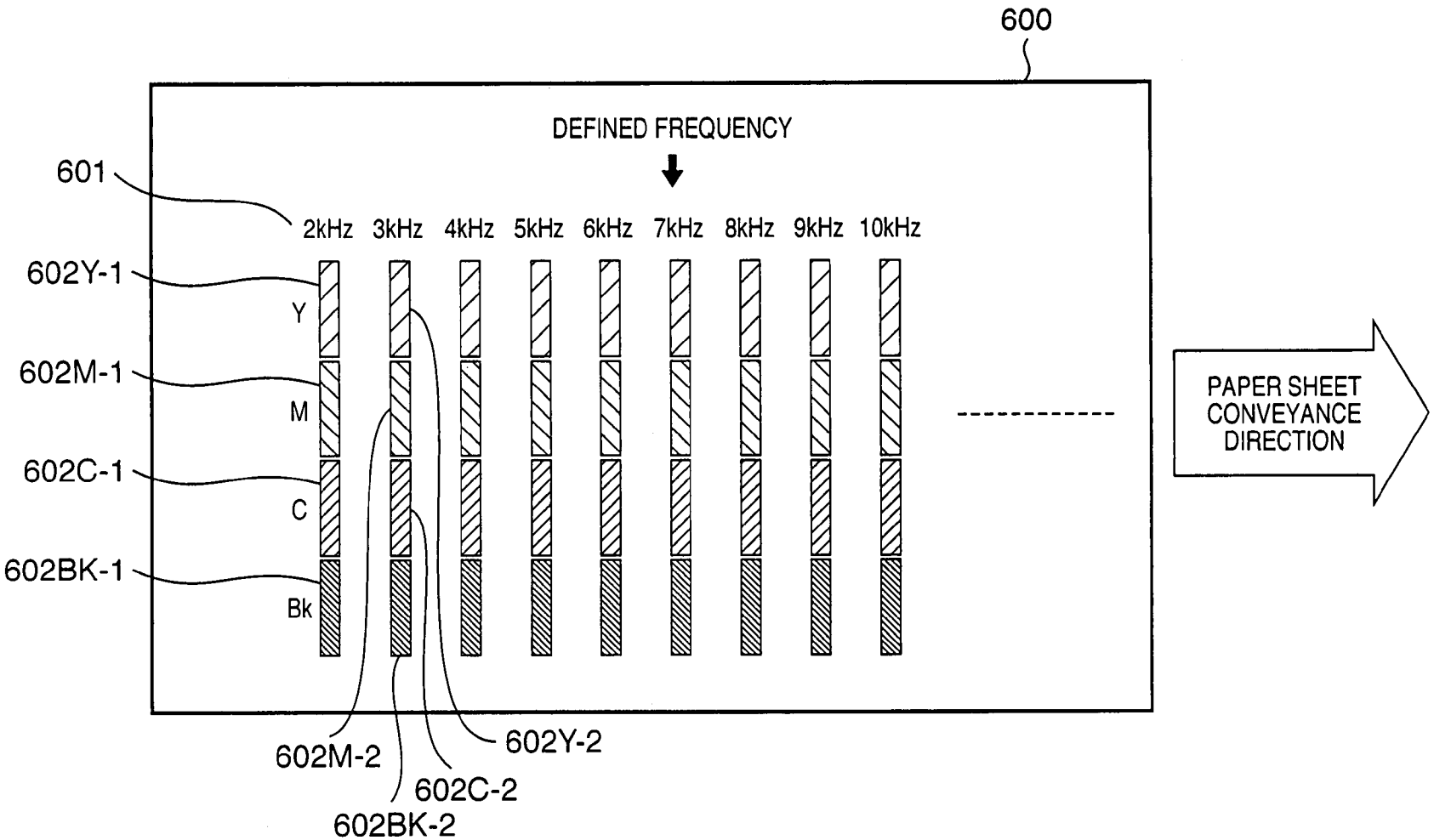
FIG. 6 is a view showing one example of a test print pattern for viscosity check.

Note that FIG. 6 is a view showing one example of a test print pattern 600 generated by executing the control programs which are stored in the program ROM 203 to generate the test print pattern. As shown in FIG. 6, in accordance with the control programs, each of the printheads (104K, 104C, 104M, and 104Y) is driven in response to a driving pulse with a frequency of 2 kHz (see reference numeral 601) to form each image 602Y-1, 602M-1, 602C-1, or 602Bk-1 with a predetermined shape. Each of the printheads (104K, 104C, 104M, and 104Y) is also driven in response to a driving pulse with a frequency of 3 kHz to form each image 602Y-2, 602M-2, 602C-2, or 602Bk-2 with a predetermined shape. After that, the frequency of the driving pulse changes by 1 kHz to form images with predetermined shapes at each frequency by using each printhead. With this operation, in accordance with the control programs for generating the test print pattern, an image print result can be obtained at each frequency using the printheads by printing the images with predetermined shapes in response to the plurality of driving pulses with different frequencies.

Figure 2:
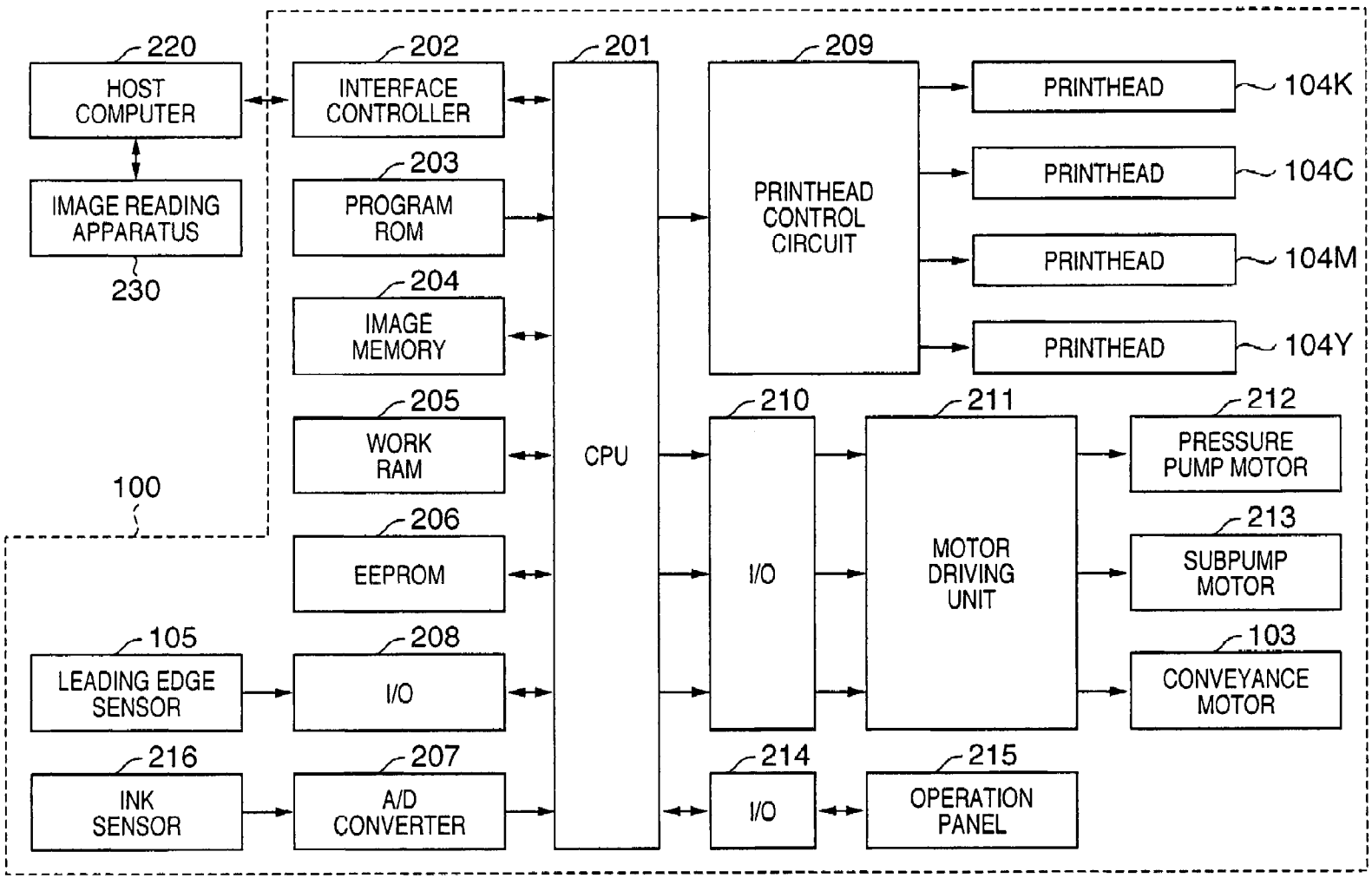
FIG. 2 is a view showing the block arrangement of the inkjet printing apparatus according to the embodiment of the present invention.

Referring to FIG. 2, an EEPROM 206 serves as a rewritable nonvolatile memory for storing the time of a previous head recovery operation (to be described later in detail), storing a correction value and the like for finely adjusting (registering) the widths of the plurality of printheads and the print position in the paper sheet conveyance direction, or storing a parameter unique to the inkjet printing apparatus 100.

Note that in ink supply operation or recovery operation of the printhead 104K, 104C, 104M, or 104Y, the CPU 201 receives a detection result from an ink sensor 216 via an A/D converter 207, and drives and controls a pressure pump motor 212 and subpump motor 213 (to be described later) via the input/output port (I/O) 210 and the motor driving unit 211. The CPU 201 also processes, via an input/output port (I/O) 214, various pieces of information input from an operation panel 215. The various pieces of information processed by the CPU 201 are displayed on the operation panel 215 via the I/O 214.

<Ink Flow in Inkjet Printing Apparatus>

A main ink flow in the inkjet printing apparatus 100 will be described next. More specifically, (1) an ink flow in supplying ink from the ink cartridge to the subtank when a new ink cartridge is mounted to replace the old ink cartridge, and (2) an ink flow in operation (head recovery operation) for recovering printhead discharge nozzles to a preferable condition will be described with reference to FIGS. 3A, 3B, and 4.

Figure 3A:
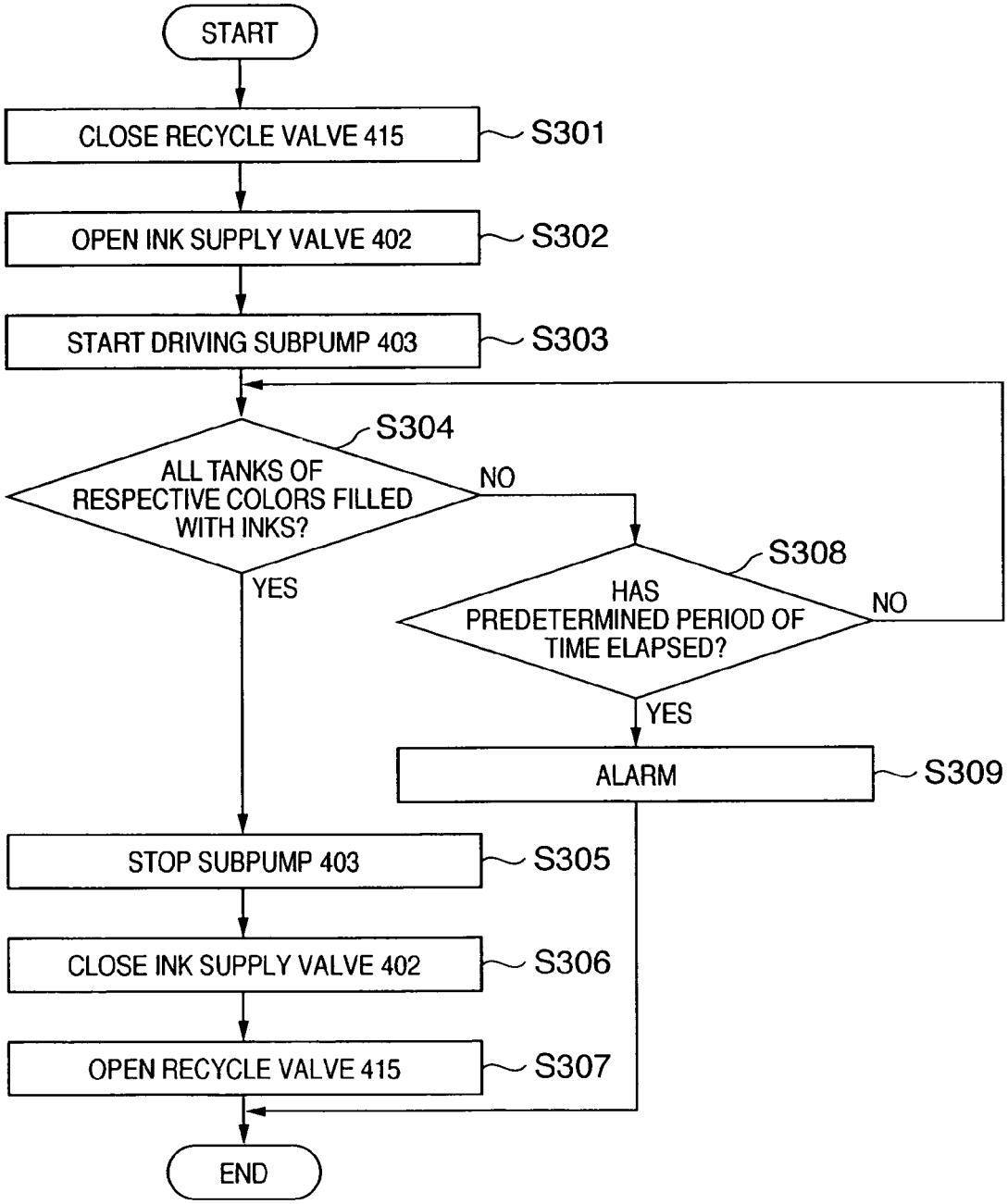
FIG. 3A is a flowchart showing the processing flow of ink supply operation in the inkjet printing apparatus.
Figure 3B:
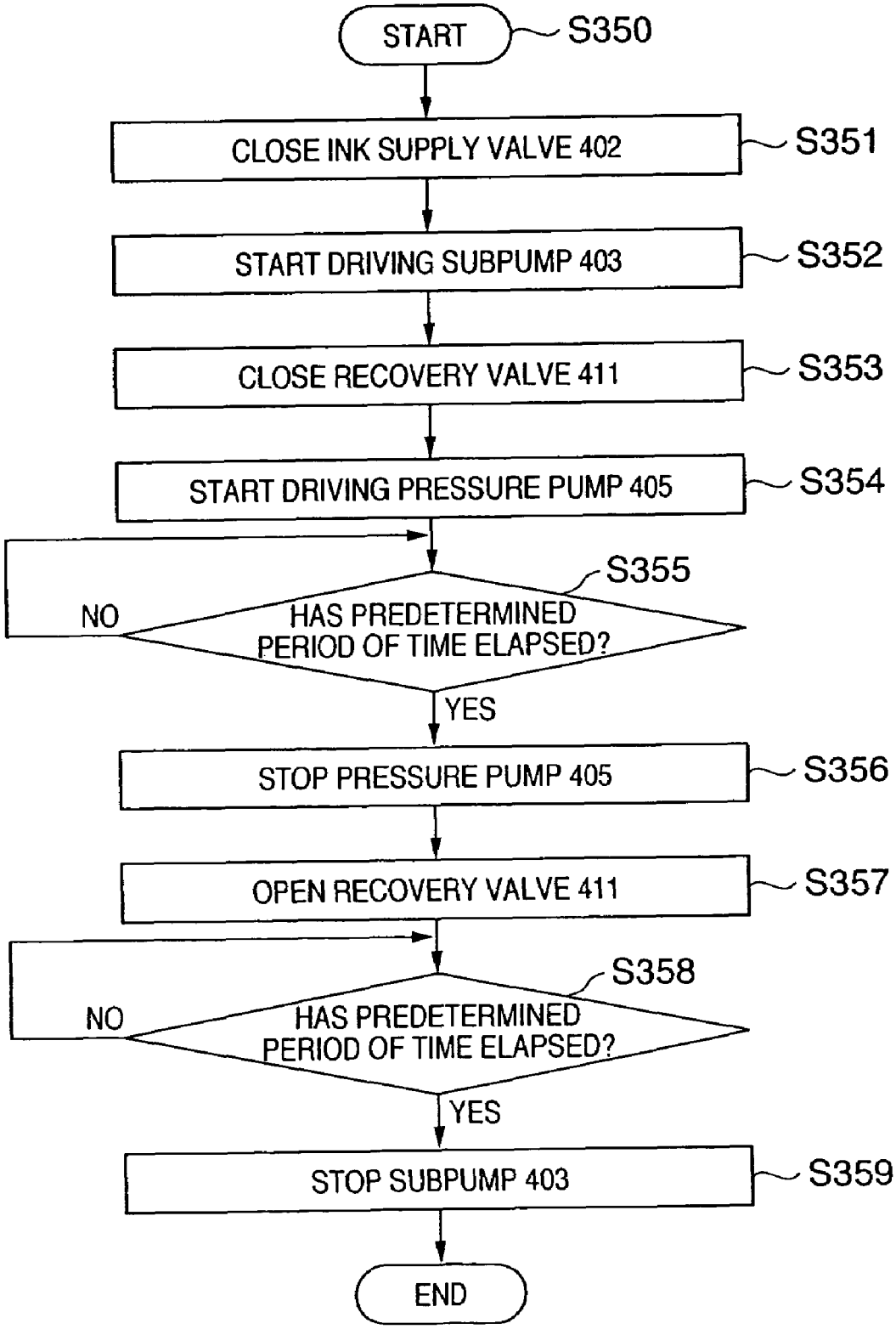
FIG. 3B is a flowchart showing the processing flow of ink recovery operation in the inkjet printing apparatus.
Figure 4:
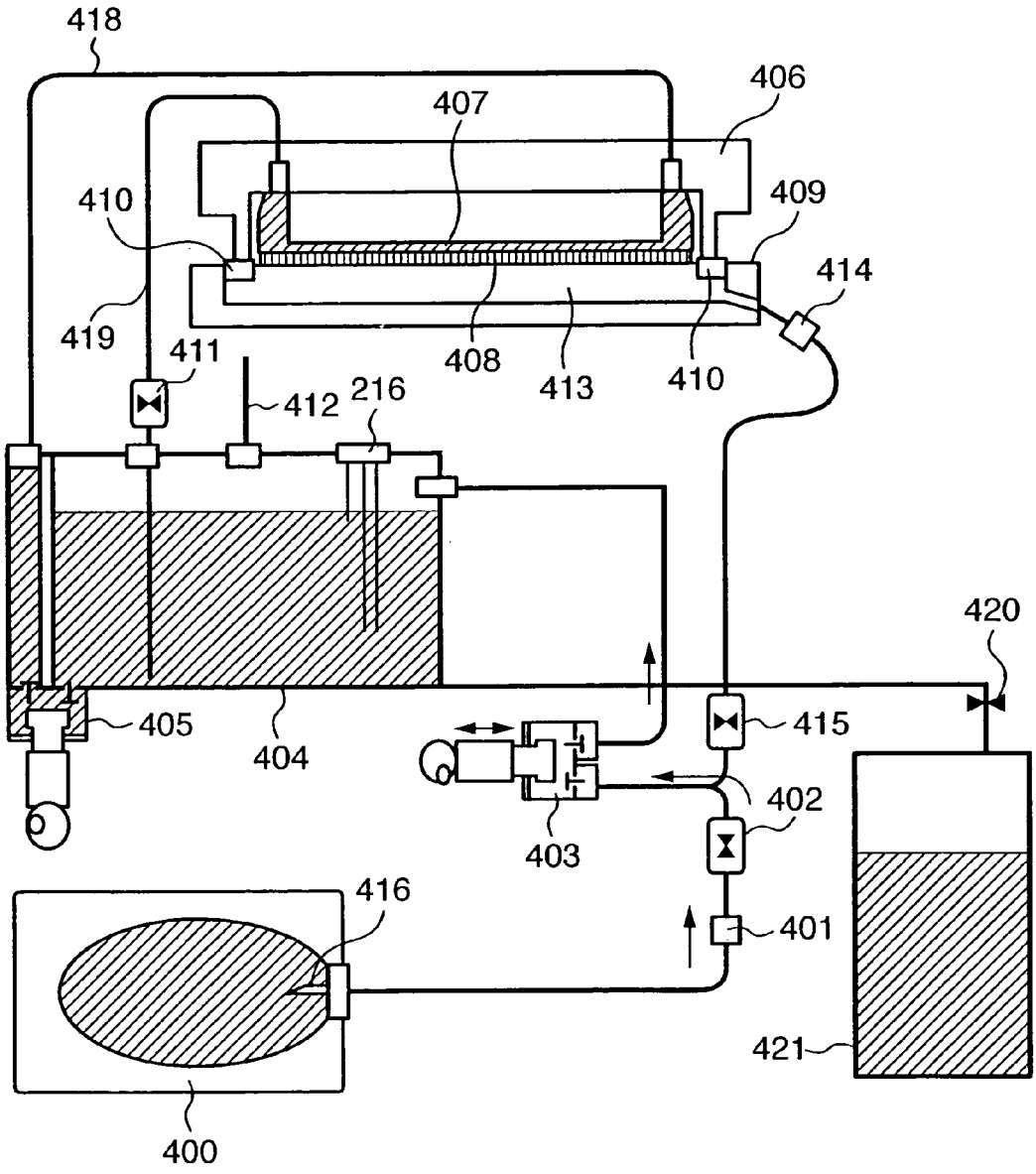
FIG. 4 is a diagram showing an ink flow in the inkjet printing apparatus.

FIG. 3A is a flowchart showing the operation flow in supplying ink from the ink cartridge to the subtank in the inkjet printing apparatus 100, and FIG. 3B is a flowchart showing the operation flow (head recovery operation) in recovering the printhead discharge nozzle to the preferable condition. FIG. 4 is a diagram showing the ink flow. As described above, the inkjet printing apparatus 100 according to the first embodiment mounts the four color ink cartridges (106K, 106C, 106M, and 106Y). In the diagram of FIG. 4, a specific one of these ink cartridges is exemplified. Each of the remaining ink cartridges has a similar arrangement.

(1) Ink Flow in Supplying Ink to Subtank when Replacing Ink

First, the ink flow in supplying ink from a newly mounted ink cartridge 400 to a subtank 404 when replacing the old ink cartridge will be described with reference to FIGS. 3A and 4.

The CPU 201 executes ink supply operation based on the control programs stored in the program ROM 203, as follows.

First, a recycle valve 415 is closed in step S301. An ink supply valve 402 is then opened (step S302), and a subpump 403 is driven (step S303).

The ink in the ink cartridge 400 is supplied to the subtank 404 through an ink supply filter 401, the ink supply valve 402, and the subpump 403. When the ink sensors 216 in the subtanks 404 sense that all the subtanks of the respective colors are filled with inks (step S304), the CPU 201 stops driving the subpumps 403 (step S305). Note that a timer is used to monitor whether all the subtanks of the respective colors are filled with inks. If not all the subtanks are filled with inks within a predetermined period of time ("YES" in step S308), an alarm is output (step S309), and processing ends.

Next, the ink supply valve 402 is closed (step S306). The recycle valve 415 is then opened (step S307), and processing ends. Note that opening/closing operation of each valve is controlled by applying a current to a solenoid coil (not shown).

(2) Ink Flow in Head Recovery Operation

Next, the ink flow in the head recovery operation in recovering the discharge nozzles of a printhead 406 to the preferable condition will be described with reference to FIGS. 3B and 4.

First, the ink supply valve 402 is closed (step S351) to start driving the subpump 403 (step S352). Then, ink is started to be sucked from an ink pool 413 in a capping mechanism 409 through a recycle filter 414, a recycle valve 415, and the subpump 403.

After that, a recovery valve 411 is closed (step S353) to drive a pressure pump 405 (step S354). Accordingly, the ink in the subtank 404 is supplied to a common ink chamber 407 of the printhead 406 through the pressure pump 405 and a tube 418. Since the recovery valve 411 is closed, the pressure in the common ink chamber 407 is increased. Thus, a relatively large amount of ink is ejected from each of the discharge nozzles of the printhead 406, and the discharge nozzles can be recovered to the preferable condition.

The ink ejected on a discharge nozzle surface 408 tends to temporarily stay in the ink pool 413 in the capping mechanism 409. However, since the subpump 403 is driven while the recycle valve 415 is open and the ink supply valve 402 is closed, the ink in the ink pool 413 is filtered through the recycle filter 414, and forced to return to the subtank 404 through the recycle valve 415 and subpump 403. That is, the ink used in the recovery operation is recycled without any waste.

When a predetermined period of time has elapsed in the above pressure state (step S355), the pressure pump 405 stops (step S356), and the recovery valve is opened (step S357). After that, when a predetermined period of time has elapsed (step S358), the subpump 403 also stops (step S359), and processing ends.

<Mode in Inkjet Printing Apparatus>

The inkjet printing apparatus 100 according to the first embodiment is used in a print mode in which the print data image received by the host computer 220 is printed, or a test print mode in which the test print pattern is generated (ink viscosity information is provided) to take an appropriate action for ink as needed. The processing flow in the test print mode will be described below.

<Processing Flow in Test Print Mode>

Figure 5:
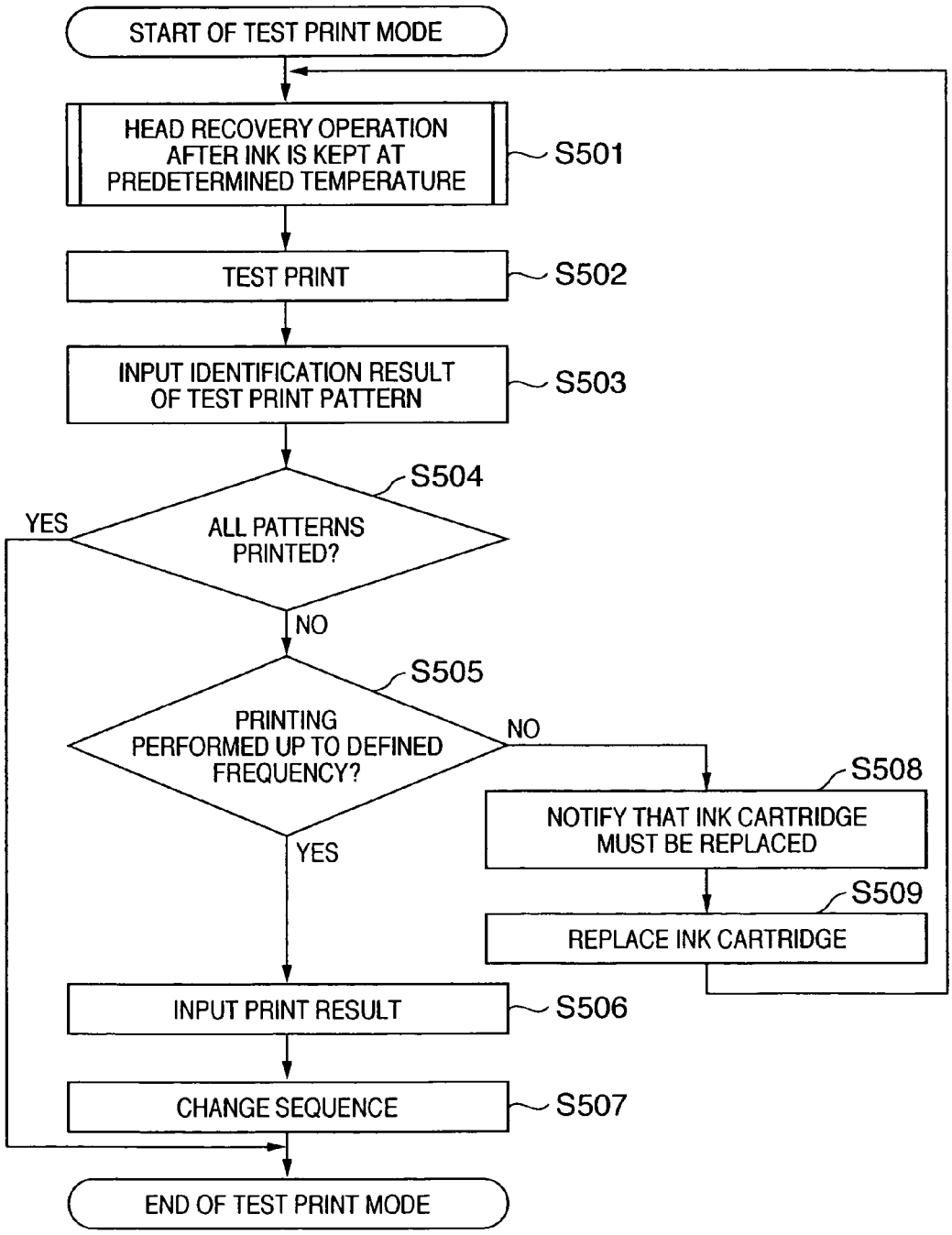
FIG. 5 is a flowchart of test print mode operation in the inkjet printing apparatus according to the embodiment of the present invention.

The processing flow in the test print mode will be described with reference to the flowchart (FIG. 5). When the test print mode starts, the ink in the head channel is kept at a predetermined temperature by a heater (heating means) (not shown), and head recovery operation is then executed (in step S501, see FIGS. 3B and 4 for head recovery operation in detail). The mode may be switched to the test print mode in accordance with a user's instruction, or automatically switched by the timer in the inkjet printing apparatus 100. Note that the user's instruction to switch to the test print mode may be issued via the operation panel 215 or host computer 220.

In step S502, test print operation is executed in accordance with the control programs for generating the test print pattern. The viscosity of the printed test print pattern image is visually identified by the user, or automatically identified by the host computer 220 on the basis of the read result from the image reading apparatus 230. More specifically, the viscosity of the test print pattern is identified based on 1) whether all the pattern images are printed, and 2) whether the viscosity value of the test print pattern exceeds the viscosity bodying limit of the inkjet printing apparatus 100. Note that whether the viscosity value of the test print pattern exceeds the viscosity bodying limit is determined based on whether the test print pattern images can be printed at up to a defined frequency (e.g., 7 kHz).

Figure 7:
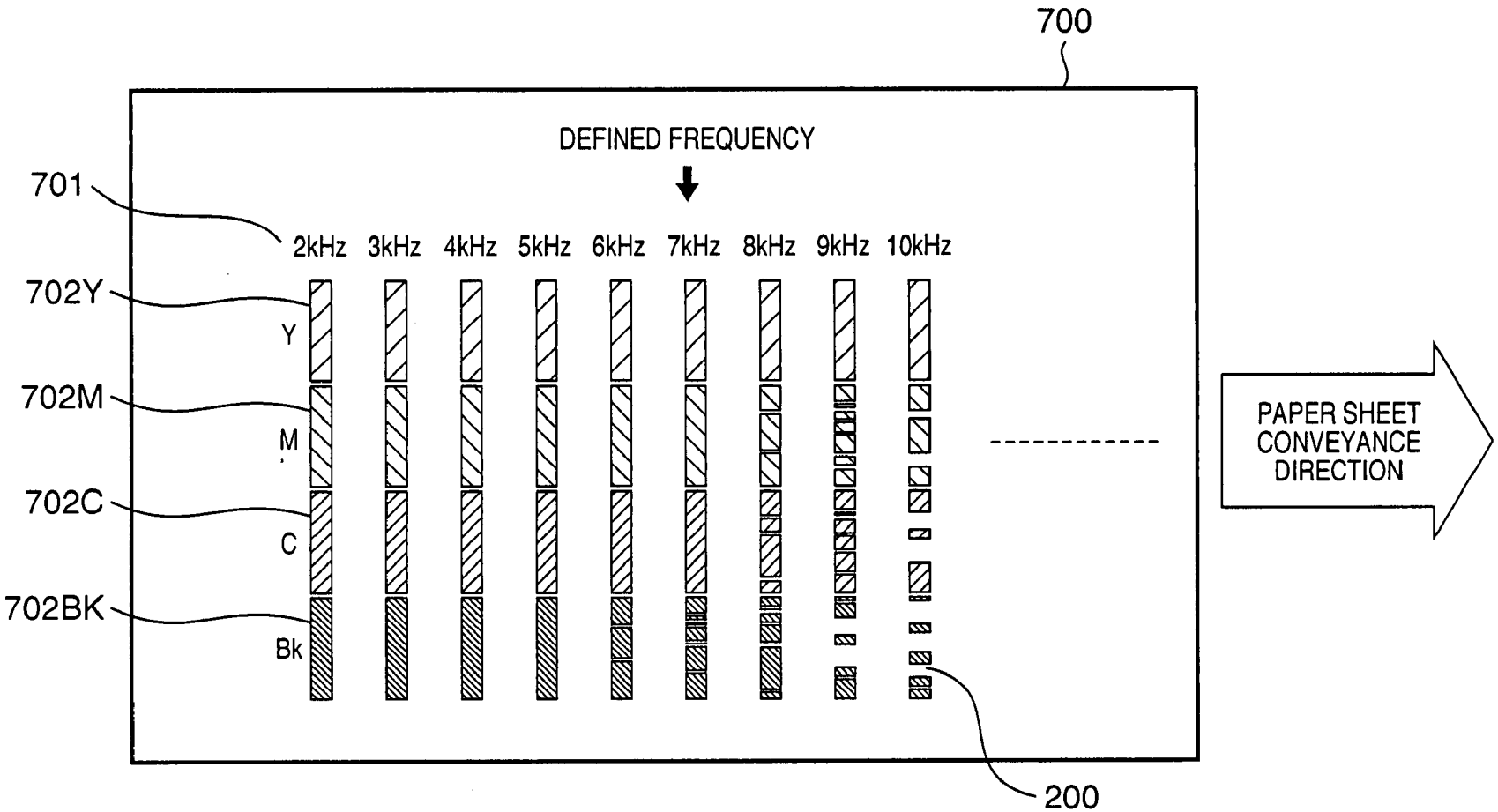
FIG. 7 is a view showing one example when the test print pattern for viscosity check is not completely printed, and a discharge error occurs.

FIG. 6 shows a state wherein image printing can be completely performed for each color at each frequency denoted by reference numeral 601. FIG. 7 shows an example when the test print pattern image is not completely printed, and ink is not discharged. As shown in FIG. 7, image printing is completely performed for each color at frequencies of 2 to 5 kHz. However, when the frequency is set equal to or higher than 6 kHz, Bk (black ink) is not discharged as a result of an increase in viscosity. When the frequency is set equal to or higher than 8 kHz, Y (yellow ink), M (magenta ink), and C (cyan ink) are not discharged (see 702Y, 702M, 702C, and 702Bk).

In step S503, the user receives the input of the identification result of the test print pattern obtained by the host computer 220. More specifically, the user receives information indicating whether all the pattern images can be printed, and information indicating whether image printing can be performed up to the defined frequency. Note that the user may directly input these pieces of information to the inkjet printing apparatus 100 via the operation panel 215, or may input these pieces of information to the host computer 220, and transmit them from the host computer 220 to the inkjet printing apparatus 100.

In step S504, processing is switched in accordance with the identification result input in step S503. That is, when information indicating that all pattern images can be printed is input in step S503, the test print mode ends. Alternatively, information indicating that all pattern images cannot be printed is input in step S503, the flow advances to step S505.

In step S505, processing is also switched in accordance with the identification result input in step S503. That is, information indicating that image printing can be performed up to the defined frequency is input in step S503, the flow advances to step S506. Alternatively, information indicating that image printing cannot be performed up to the defined frequency is input in step S503, the flow advances to step S508 to display, on the operation panel 215, a message to replace the ink cartridge with a new one. This message may be displayed not only on the operation panel 215 but also, e.g., on the host computer 220 via the interface controller 202.

The user who receives the message display inputs an instruction to replace the ink cartridge 400. Upon reception of this instruction, the inkjet printing apparatus 100 executes a series of ink replace processes (step S509). More specifically, a valve 420 in the channel between the subtank 404 and a waste ink tank 421 is opened to remove ink into the waste ink tank 421 by water head pressures of the subtank 404 and waste ink tank 421. When ink has been removed to the waste ink tank 421, a message indicating this is displayed on the operation panel 215 or the host computer 220. When the user sets a new ink cartridge 400 in accordance with this display, the inkjet printing apparatus 100 performs ink supply operation (see FIGS. 3A and 4 in detail). With this operation, ink cartridge replacement is completed, and the flow returns to step S501. Note that at this time, various recovery operations such as wiping operation of the nozzle surface 408 of the printhead using a wiper blade are also executed.

On the other hand, in step S506, various pieces of information obtained from the printed test pattern image are input. The various pieces of information obtained from the printed test print pattern image include, for example, information about the frequency at which ink is not discharged, and information about the discharge error occurrence rate at the frequency at which ink is not discharged.

In step S507, an image printing sequence or recovery sequence is changed by collating the various pieces of information input in step S506 with the information stored in the program ROM 203. Note that a "change in image printing sequence" means a change in various pieces of information such as ink discharge amount in image printing processing. Also, a "change in recovery sequence" means a change in various pieces of information such as ink circulation time (see FIG. 4 in detail) in ink processing other than image printing.

Upon completion of sequence change processing in step S507, the test print mode ends, and the mode shifts to the print mode.

As is apparent from the above description, in the first embodiment, since ink is discharged in response to the driving pulses with the different frequencies in the test print mode, ink viscosity information (test print pattern) can be provided. In this method, the ink viscosity information can be provided without a specific device such as a sensor, and the information can be provided at lower cost in smaller space than a conventional one.

Note that the first embodiment has been described by exemplifying an apparatus which employs an ink recycling scheme, in which evaporation of ink components is considerable. However, the present invention is not limited to this. The present invention can also be applied to an apparatus which employs a non-recycling scheme.

Second Embodiment

In the first embodiment, an ink discharge amount changes as a change in an image printing sequence. However, the present invention is not limited to this. For example, stable discharge corresponding to a change in ink viscosity may be implemented by adjusting an ink temperature in a channel of a printhead 406 using a heater (heating means).

Third Embodiment

In the first embodiment, an ink discharge amount changes as a change in an image printing sequence. However, the present invention is not limited to this. For example, stable discharge corresponding to a change in ink viscosity may be implemented by adjusting discharge energy of a printhead 406.

Fourth Embodiment

In the first embodiment, an ink discharge amount changes as a change in an image printing sequence. However, the present invention is not limited to this. For example, stable discharge corresponding to a change in ink viscosity may be implemented by adjusting the interval (time) between discharge processes (i.e., adjusting the frequency of a driving pulse) of a printhead 406.

Fifth Embodiment

In the first embodiment, an ink circulation time changes as a change in an image recovery sequence. However, the present invention is not limited to this. Stable discharge corresponding to a change in ink viscosity may be implemented by adjusting the amount of the ink circulating in the channel of a printhead 406.

Sixth Embodiment

In the first embodiment, an ink circulation time changes as a change in an image recovery sequence. However, the present invention is not limited to this. Stable discharge corresponding to a change in ink viscosity may be implemented by adjusting the pressure in a channel when ink circulates in the channel of a printhead 406.

Other Embodiment

The object of the present invention is realized even by supplying a storage medium storing software program codes for realizing the functions of the above-described embodiments to a system or an apparatus, and causing the computer (or a CPU or an MPU) of the system or the apparatus to read out and execute the program codes stored in the storage medium.

In this case, the program codes read out from the storage medium realize the functions of the above-described embodiments by themselves, and the storage medium storing the program codes constitutes the present invention.

As a storage medium for supplying the program codes, a floppy® disk, a hard disk, an optical disk, a magnetooptical disk, a CD-ROM, a CD-R, a magnetic tape, a nonvolatile memory card, a ROM, or the like can be used.

The functions of the above-described embodiments are realized not only when the readout program codes are executed by the computer but also when the OS (Operating System) running on the computer performs part or all of actual processing on the basis of the instructions of the program codes.

The functions of the above-described embodiments are also realized when the program codes read out from the storage medium are written in the memory of a function expansion board inserted into the computer or a function expansion unit connected to the computer, and the CPU of the function expansion board or function expansion unit performs part or all of actual processing on the basis of the instructions of the program codes.

The present invention is not limited to the above embodiments and various changes and modifications can be made within the spirit and scope of the present invention. Therefore, to apprise the public of the scope of the present invention, the following claims are made.

This application claims the benefit of Japanese Application No. 2005-030567 filed on Feb. 7, 2005, which is hereby incorporated by reference herein in its entirety.

What is claimed is:

1. An inkjet printing apparatus which prints an image using a printhead having a plurality of nozzles from which ink is discharged, comprising:

a switching unit configured to switch to a test print mode for providing information about a viscosity of the ink;

an image printing unit configured to print predetermined images in response to a plurality of driving pulses at different frequencies when said switching unit switches to the test print mode; and a moving unit configured to move the ink through a predetermined channel for a predetermined duration of time, wherein said moving unit can change the duration of time for moving the ink depending on the result of the image printing by said image printing unit.

2. The apparatus according to claim 1, further comprising a heating unit configured to heat up a channel of the ink to a predetermined temperature.

3. The apparatus according to claim 1, further comprising a plurality of printheads, wherein each of the plurality of printheads discharges ink of a different color.

4. The apparatus according claim 1, wherein a pulse width of each driving pulse output in image printing can be arbitrarily changed.

5. The apparatus according to claim 1, further comprising a heating unit configured to heat up a channel of the ink, wherein a temperature in the channel of the ink in image printing can be arbitrarily changed by said heating unit.

6. The apparatus according to claim 1, wherein heat energy supplied in response to each driving pulse in image printing can be arbitrarily changed.

7. The apparatus according to claim 1, wherein the frequency of the driving pulses in image printing can be arbitrarily changed.

8. An ink jet printing method of an inkjet printing apparatus which applies heat energy corresponding to a driving pulse to ink to generate bubbles by film boiling, and discharges ink from a printhead onto a print medium by the generated bubbles to print an image, comprising:

a switching step of switching between a test print mode for providing information about a viscosity of the ink and a print mode for printing an image based on input print data;

an image printing step of printing images with predetermined shapes in response to a plurality of driving pulses at different frequencies when switching to the test print mode in the switching step; and a moving step of moving the ink through a predetermined channel for a predetermined duration of time, wherein the duration of time for moving the ink can be changed in the moving step depending on the result of the image printing in the image printing step.

9. The method according to claim 8, further comprising a heating step of heating a channel of the ink, wherein the channel of the ink is heated to a predetermined temperature in the test print mode in the heating step.

10. The method according to claim 8, wherein the printing apparatus further comprises a plurality of printheads, and each of the plurality of printheads discharges ink of a different color.

11. The method according to claim 8, wherein a pulse width of each driving pulse output in image printing can be arbitrarily changed.

12. The method according to claim 8, further comprising a heating step of heating a channel of the ink, wherein a temperature in the channel of the ink in image printing can be arbitrarily changed in the heating step.

13. The method according to claim 8, wherein heat energy supplied in response to each driving pulse in image printing can be arbitrarily changed.

14. The method according to claim 8, wherein a frequency of each driving pulse in image printing can be arbitrarily changed.

15. A storage medium which stores a control program for causing a computer to execute an ink jet printing method defined in claim 8.

16. A control program for causing a computer to execute an ink jet printing method defined in claim 8.

* * * * *